US009573715B2

(12) United States Patent
Bikerman et al.

(10) Patent No.: US 9,573,715 B2
(45) Date of Patent: Feb. 21, 2017

(54) INFUSION BAG DISPENSING SYSTEM

(71) Applicants: David Bikerman, New York, NY (US); Thomas Muckle, Old Lyme, CT (US)

(72) Inventors: David Bikerman, New York, NY (US); Thomas Muckle, Old Lyme, CT (US)

(73) Assignee: David Bikerman, New York, NY (US)

( * ) Notice: Subject to any disclaimer, the term of this patent is extended or adjusted under 35 U.S.C. 154(b) by 0 days.

(21) Appl. No.: 14/250,434

(22) Filed: Apr. 11, 2014

(65) Prior Publication Data

US 2016/0059977 A1 Mar. 3, 2016

(51) Int. Cl.

| | |
|---|---|
| ***B65B 29/02*** | (2006.01) |
| ***B65B 43/14*** | (2006.01) |
| ***B65B 43/20*** | (2006.01) |
| ***B65B 43/26*** | (2006.01) |
| ***B65B 43/44*** | (2006.01) |
| ***B65B 43/54*** | (2006.01) |
| ***B65D 77/00*** | (2006.01) |

(52) U.S. Cl.
CPC ..... *B65B 43/20* (2013.01); *B65B 29/02* (2013.01); *B65B 43/26* (2013.01)

(58) Field of Classification Search
CPC ..... B65B 29/02; B65B 39/06; B65B 39/08; B65B 43/14; B65B 43/20; B65B 43/26; B65B 43/44; B65B 43/265; B65B 43/54; B65D 33/1675; B65D 77/00; B65D 85/808; A47J 31/4425
USPC ... 383/12, 33, 34, 43, 906; 206/554; 53/147, 53/384.1; 221/33
See application file for complete search history.

(56) References Cited

U.S. PATENT DOCUMENTS

| | | | | |
|---|---|---|---|---|
| 2,950,589 | A * | 8/1960 | Litchard | B65B 43/30 271/107 |
| 3,605,383 | A * | 9/1971 | Piazze | B65B 67/1266 53/385.1 |
| 3,685,252 | A * | 8/1972 | Wouda | B65B 67/04 53/385.1 |
| 3,732,662 | A * | 5/1973 | Paxton | B65D 33/1625 53/135.1 |
| 4,172,349 | A * | 10/1979 | Lipes | B65B 43/28 53/384.1 |
| 4,700,755 | A * | 10/1987 | Banys | B65B 43/34 141/114 |

* cited by examiner

*Primary Examiner* — Andrew M Tecco
*Assistant Examiner* — Praachi M Pathak

(57) ABSTRACT

This disclosure relates to infusion bags for infusible substance such as tea or herbs or the like for which separation of the infusible substance from liquid is desired. The disclosure also relates to a device which provides function of storing empty infusion bags in a container, and retrieving the empty bag individually from the container, holding and opening the retrieved bag for filling, and ejecting the filled bag for use. The infusion bags and device of the present invention is ideal for making hot tea or herbal beverages, and for other infusion needs in cooking where separation of the infused material from liquid is desired.

18 Claims, 23 Drawing Sheets

INFUSION BAG DISPENSING SYSTEM

BACKGROUND OF THE INVENTION

Field of the Invention

This invention relates generally to infusion bags and to an infusion bag dispensing system, and more particularly to infusion bags and to an infusion bag dispenser that can be used to package the infusion bags at home, within a store environment or within a work or office setting.

Description of Related Art

Infusion bags used for preparing tea, herbal beverages or the like are known in the prior art. More specifically, by way of example, U.S. Pat. No. 7,235,273 to Ruston discloses an infusion bag having a means for selectively inserting any desired dry beverage material.

U.S. Pat. No. 4,605,123 to Goodrum et. al. discloses an infusion bag for particulated food products such as tea, coffee and the like, constructed of a tube of perforated thermoplastic film or other porous material.

U.S. Pat. No. 6,746,699 to Lohrey et al. discloses an infusion bag especially for tea, which has a top part with folded down corners and a middle part folded over it, to which a string with two free ends is attached.

U.S. Pat. No. 4,551,336 to Chen discloses an improved infusion bag for preparing an infusion of tea or other infusible substance, which makes the infusible substance less compacted and overcomes the constraint. This gives a higher quantity and higher concentration of infusion liquor.

To package one's own infusion bags for tea, for a herb tea beverages, or the like for which separation of the infusible substance from liquid is desired often times results in a tedious and cumbersome process. Tradition is such that a person needs to get a sachet, hold it open, and transfer the desired infusible material into the sachet. Therefore, it is desirable to have a device, for example, an infusion bag dispenser, which can help to facilitate such packaging and remove the need for a preparation process that requires many ancillary items stored and employed by the end-user.

However, there is no infusion bag dispenser available for people to help or facilitate for them the packaging of their own infusion bags at home, within a store, or within a work settings—to prepare their own tea or herbal beverage or the like.

Therefore there is a need for an infusion bag dispensing system for tea, herb leaves, and the like. Such a system can store the empty infusion bags in a container, retrieve the bag, hold the bag and open the bag for a user to fill the infusible substance for use, and dispense the filled infusion bag.

SUMMARY OF THE INVENTION

This disclosure relates to infusion bags for infusible substances such as tea or herbs or the like for which separation of the infusible substance from liquid is desired. The disclosure also relates to a device which provides function of storing empty infusion bags in a container, and retrieving the empty bag individually from the said container, holding the retrieved bag for filling, and ejecting the filled bag for use. The infusion bags and dispenser of the present invention is ideal for making hot tea or herbal beverages, and for other infusion needs in cooking where separation of the infused material from liquid is desired.

In an exemplary embodiment of the present invention, there is disclosed an infusion bag dispensing system, comprising a plurality of empty infusion bags to receive infusible substance, each of the infusion bags having a porous-walled bag for the infusible substance, an open/close mechanism along the top of the bag; and an infusion bag dispenser which provides function of storing empty infusion bags in its container, retrieving the empty bag individually from the container, holding the retrieved bag for filling, and ejecting the filled bag for use.

The infusion bag dispenser retrieves the empty bag from the bottom of the container in one embodiment and retrieves the empty bag from the top of the container in another embodiment. The infusion bag dispenser stores the infusion bags horizontally in some embodiments and vertically in other embodiments.

The dispenser opens the infusion bag by applying force to the open/close clip on the bag in some embodiments and by inserting spades into the bag in another embodiment.

In one embodiment, the infusion bag dispenser retrieves the infusion bag one at a time by attaching a pair of hooks or pins to the pair of holes at the open/close clip. In another embodiment a pair of spades are inserted into the infusion bag to retrieve it, and the spades are rotated in order to open the infusion bag. Other mechanism known in the art may be used to retrieve and open the infusion bag in another embodiment.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
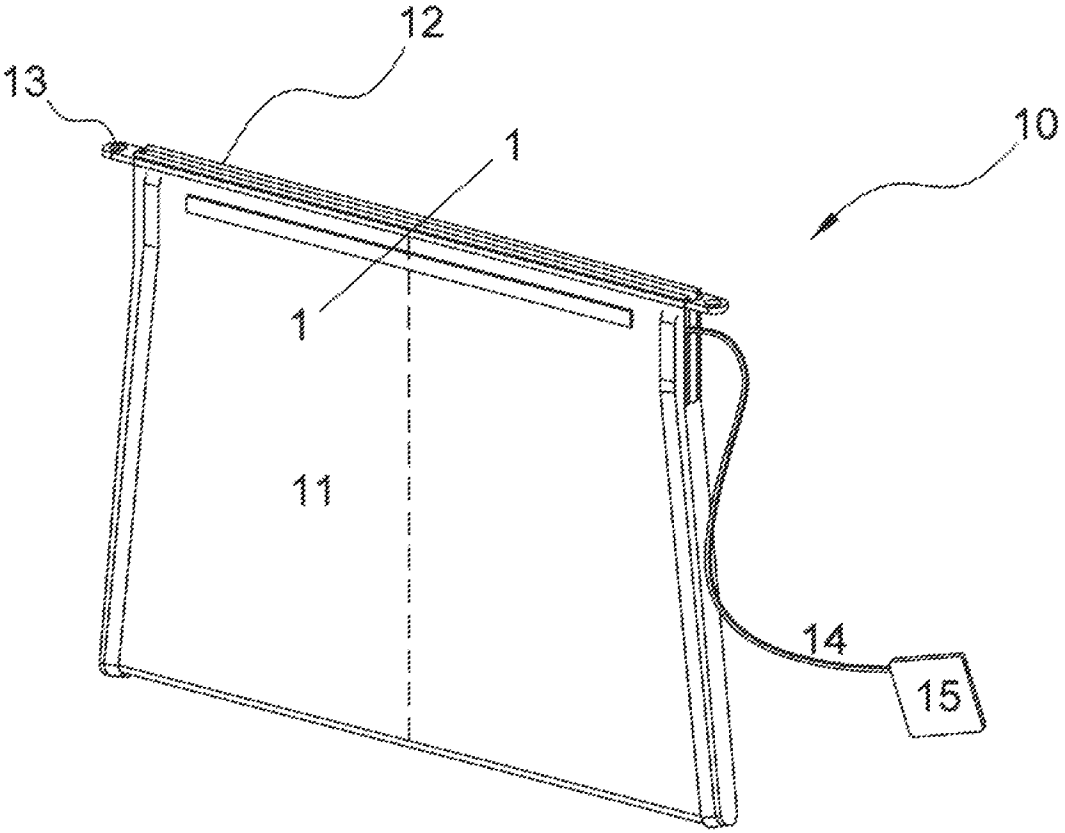
FIG. 1 is a perspective front view of an infusion bag according to one embodiment of the present invention.
Figure 2:
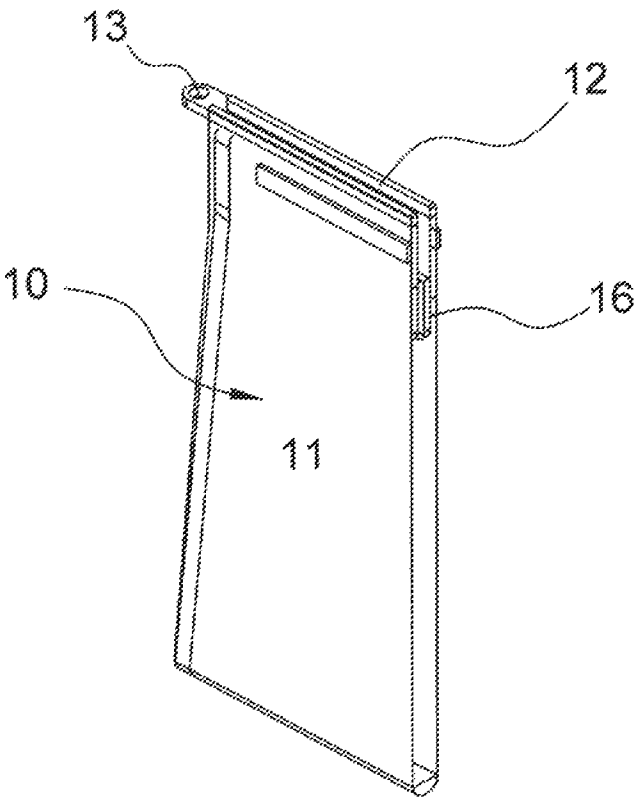
FIG. 2 is a sectional view of the embodiment of the infusion bag along the line 1-1 of FIG. 1.

Referring to FIGS. 1 and 2, there is disclosed a front view and sectional view of an infusion bag 10 according to one embodiment of the present invention, comprising a porous-walled bag 11 for the infusible substance, an open/close clip 12 along the top of the bag, and two holes 13 located at two ends of the open/close clip, a string 14 and tab 15. The infusion bag 10 further comprises an internal seal 16 below and along the open/close clip 12.

The bag 11 and open/close mechanism clip 12 is designed so that it will open when pressure is applied and close when the pressure is removed which also leads to opening and closing of the internal seal 16. The internal seal 16 prevents materials from exiting the bag when it is closed. The bag 11 and clip 12 can be constructed of different materials including but not limited to metal, plastic, and organic materials such as bamboo. The bag 11 and clip 12 can be attached together by different methods including but not limited to by heating, stitching, and other means known in the art.

Figure 3:
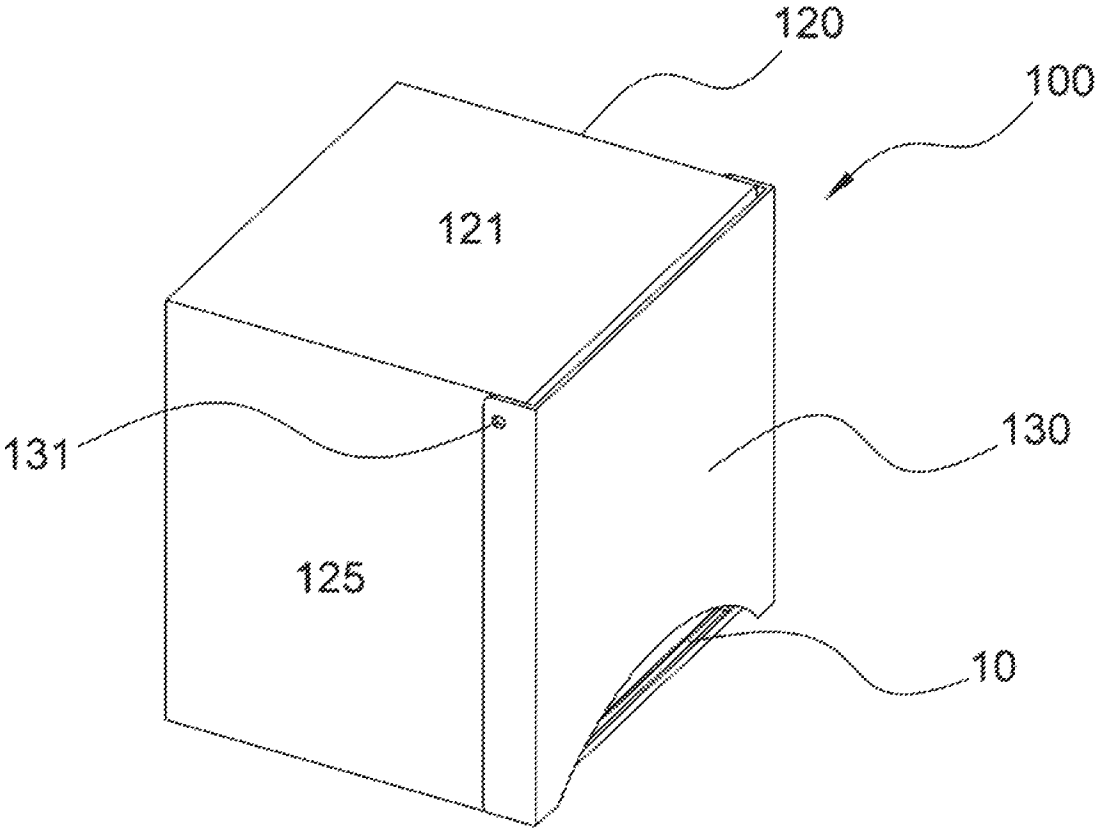
FIG. 3 is an isometric view of the infusion bag dispenser according to one embodiment of the present invention showing that the infusion bags are stored inside the container and the door is in a closed position.

Referring to FIG. 3, there is disclosed the first embodiment of the infusion bag dispenser 100, comprising a substantially rectangular shaped container 120 for storing the infusion bags 10 and a bag retrieving and opening mechanism 130 for retrieving the infusion bag out of the container 120.

Figure 4:
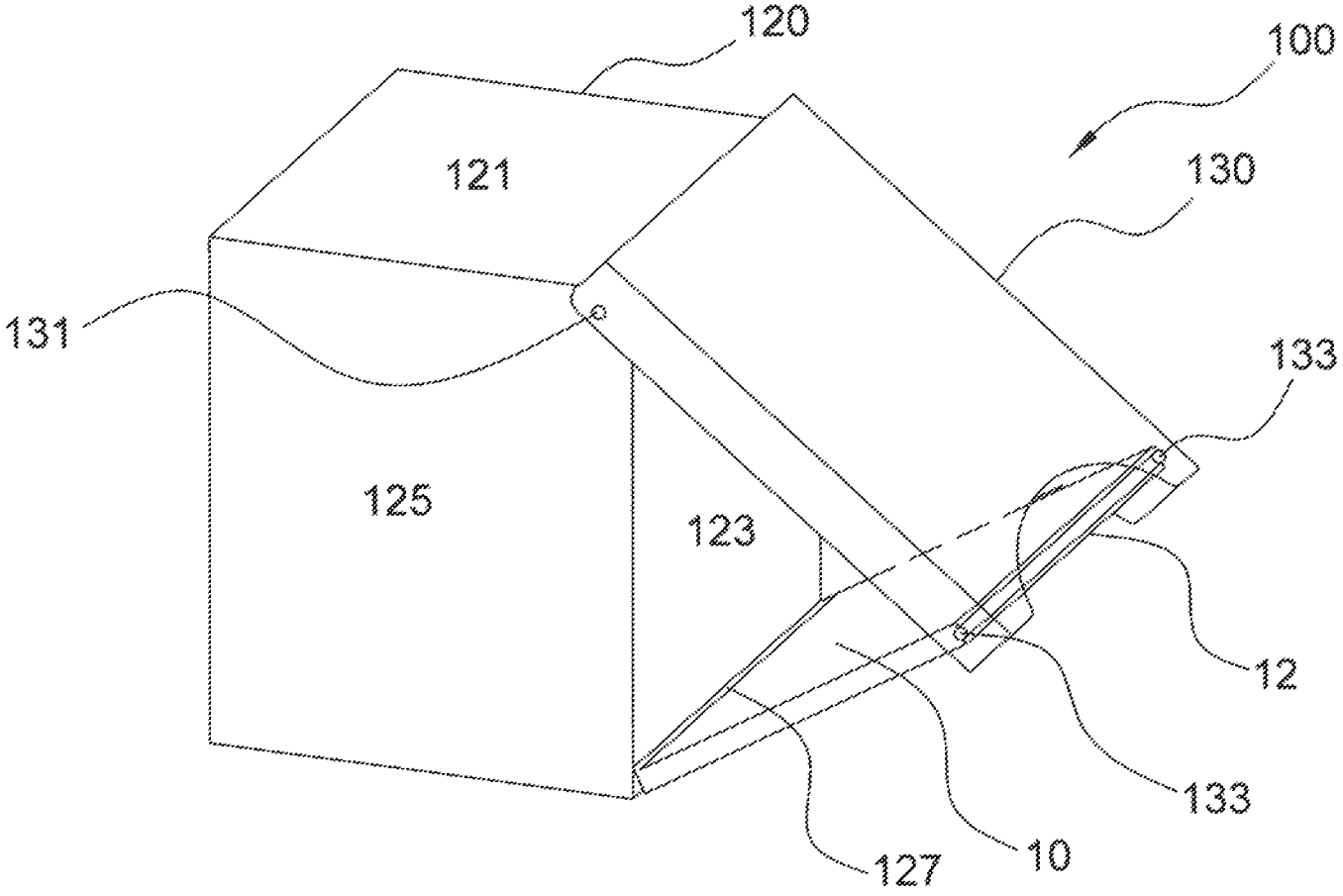
FIG. 4 is an isometric view of the embodiment of FIG. 3 showing the door is in a half-open position and retrieving one piece of the infusion bags out of the container.

Referring to FIG. 4, the container has two horizontal walls which are a top 121 and a bottom (not observable in the figure), and four vertical walls which are a front 123, a rear (invisible in the figure), a right side (not visible in the figure), and a left side 125. The front wall 123 in the figure is slightly shorter than the other three vertical walls forming a gap 127 at its bottom allowing one single piece of the infusion bags 10 to get out of the container 120.

The bag retrieving and opening mechanism 130 is connected to the container 120 at the top via hinge(s) 131 so that the bag retrieving and opening mechanism 130 can pivot approximately 90 degrees from a vertical close position (see FIG. 3) where the bag retrieving and opening mechanism 130 covers the front wall 123 to a horizontal open position that will be demonstrated later in FIG. 5. To retrieve the infusion bag 10 out of the container 120 through the gap 127, the bag retrieving and opening mechanism 130 has a pair of hooks or pins 133 that resides on the interior surface so when the bag retrieving and opening mechanism 130 is closed, the pair of hooks or pins 133 mates with the corresponding holes 3 of the infusion bag 10 and the infusion bag 10 becomes attached to the bag retrieving and opening mechanism 130 and thus is pulled out of the gap 127 when the bag retrieving and opening mechanism 130 is opened.

Figure 5:
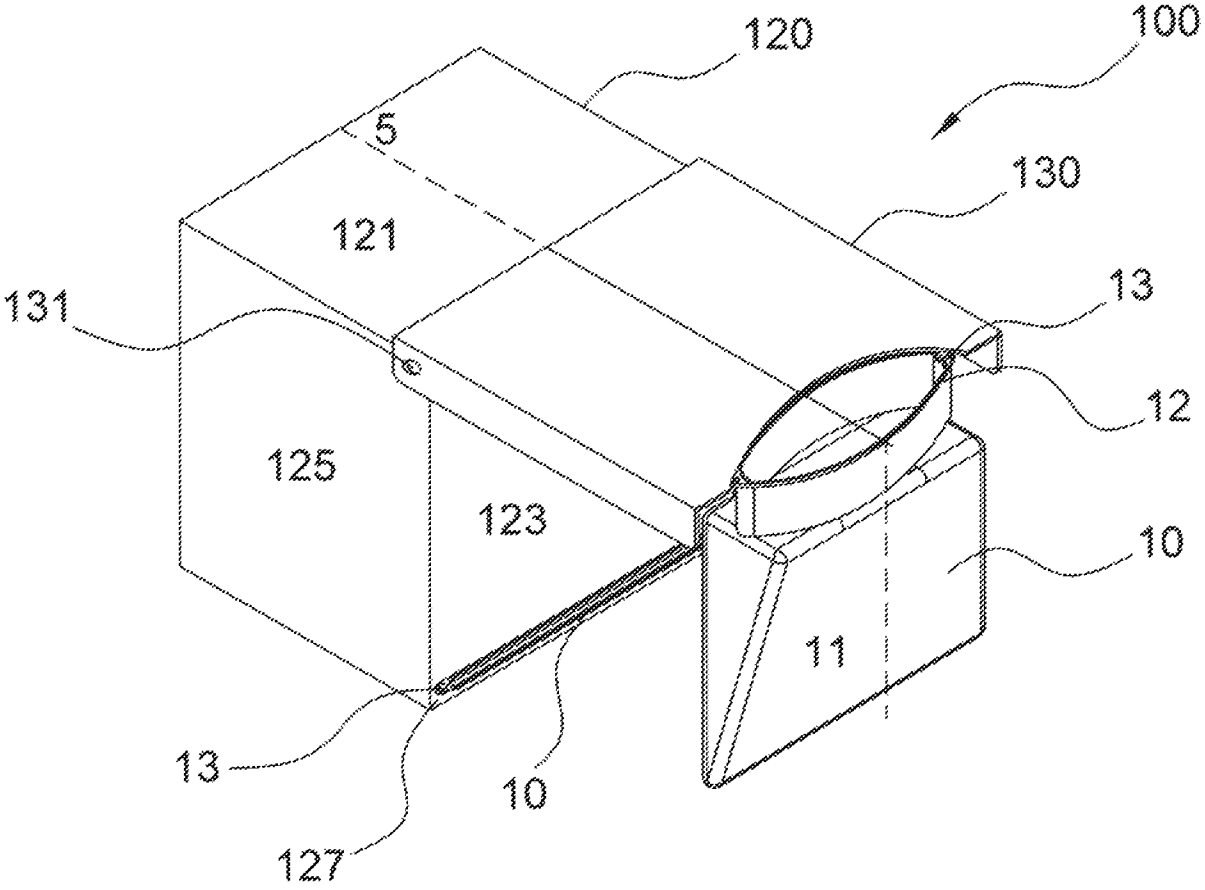
FIG. 5 is an isometric view of the embodiment of FIG. 3 showing that the door is in an open position and the infusion bag is attached to the door with the open/close clip opened ready for filling infusible substance.

As shown in FIG. 5, the infusion bag 10 is retrieved from the bottom of the container 120 through the gap 127 one at a time by the hooks or pins 133 on the bag retrieving and opening mechanism 130 and is held in a vertical position when the bag retrieving and opening mechanism 130 is held in a horizontal position. Other mechanisms known in the art can be used to attach to the infusion bag.

The infusion bag dispenser 100 further comprises a mechanism which applies force with the use of a compression spring to open the clip 120 of the infusion bag 10 for a user to fill desired infusible substance as shown in FIG. 5.

Figure 6:
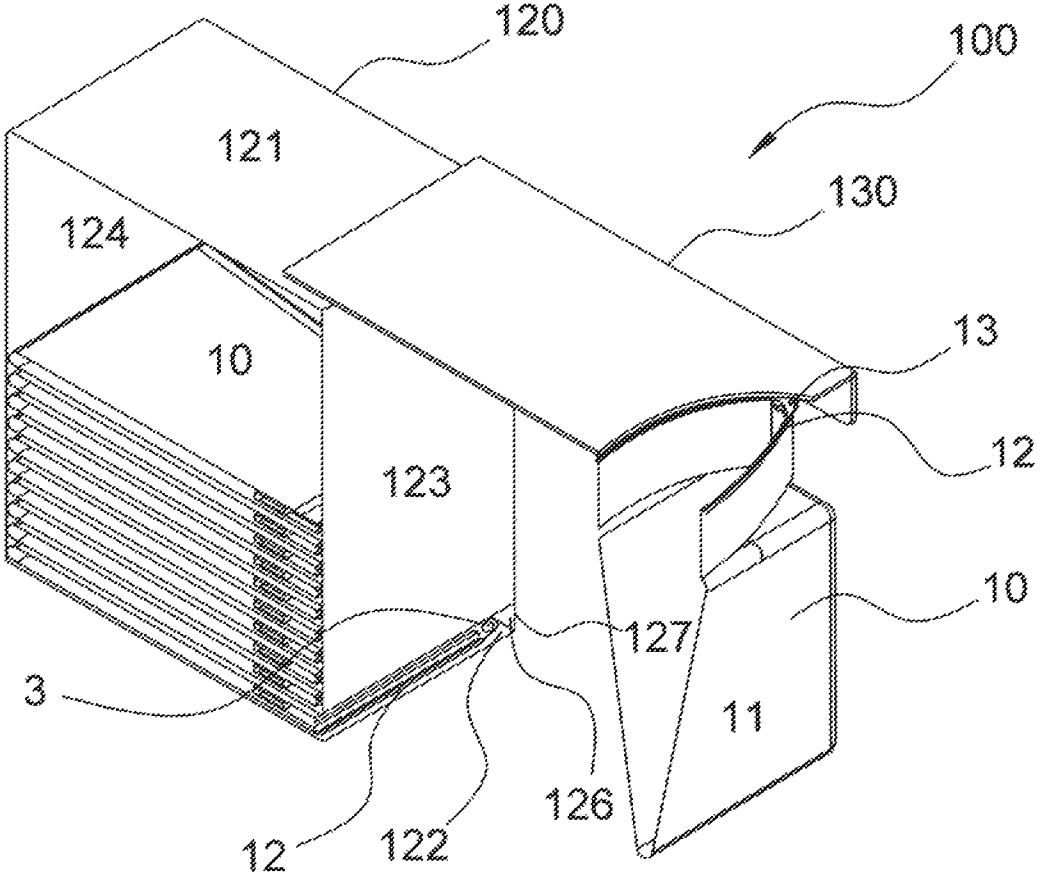
FIG. 6 is a sectional view of the embodiment along the line 5-5 of FIG. 5 showing that infusion bags are stored inside the container.

FIG. 6 is a sectional view along the line 5-5 of the embodiment. In FIG. 6, partial of the right side 126, bottom 122, and rear 124 walls are observable. A plurality of infusion bags 10 are stored horizontally from the bottom up inside the container 120 with the open/close clip 12 and hole 13 next to and facing towards the gap 127 on the front wall 123.

One of the vertical walls excluding the front wall 123 is hingedly connected to one of its adjacent walls so that it can be opened and allow a user to put empty infusion bags inside the container.

Figure 7:
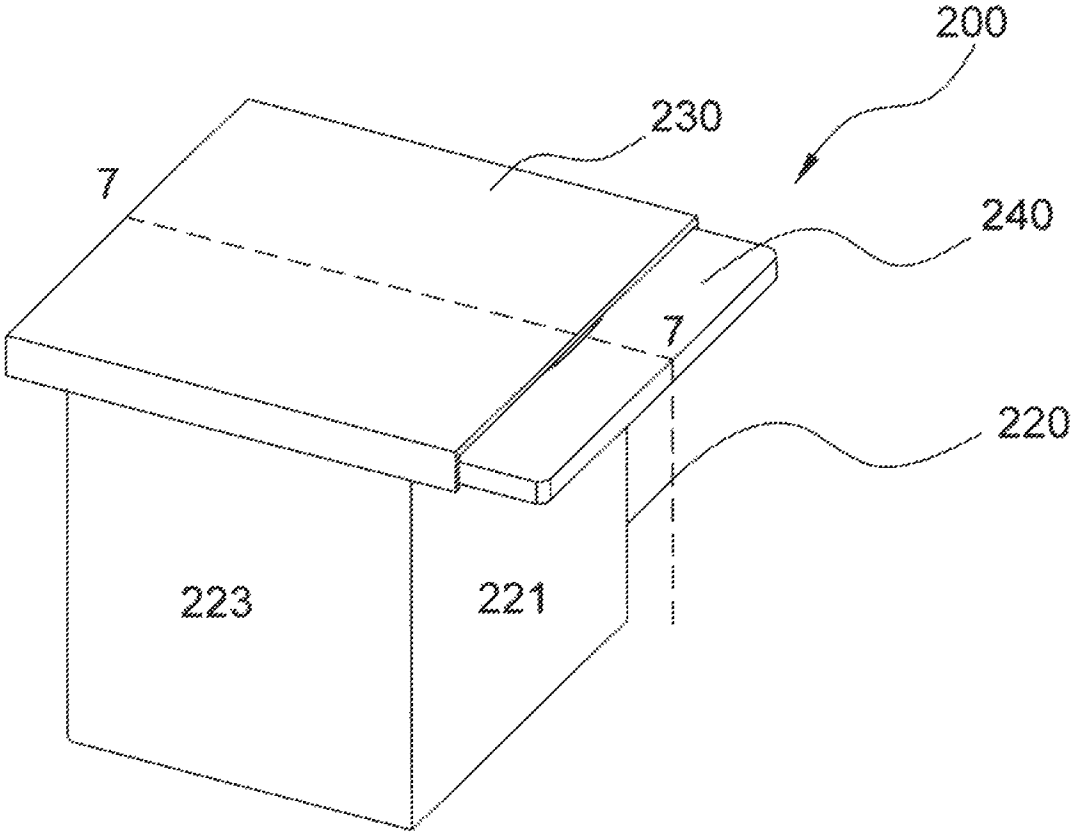
FIG. 7 is an isometric view of the infusion bag dispenser according to another embodiment of the present invention showing that the sliding bag retriever is in a closed position wherein the infusion bags are stored inside the container and not observable.

Referring to FIG. 7, there is disclosed the second embodiment of the infusion bag dispenser 200, comprising a substantially rectangular shaped container 220 for storing the infusion bags 10, a dispenser lid 230, and a bag retrieving and opening mechanism 240.

The container 220 has four vertical walls including a front 221, a rear 222, a right side 224, a left side 223, a bottom 225, and an open top. The rear 222, right side 224, bottom 225, and open top are not observable in FIG. 7 but is partially visible in FIG. 8. The dispenser lid 230 is connected to the top of the container 220 to cover the open top and to hold the bag retrieving and opening mechanism 240 in a closed position. The bag retrieving and opening mechanism 240 is sized and configured to mate the infusion bag 10 and the dispenser lid 230 so that it can slide in and out of the dispenser lid 230 to retrieve the infusion bag 10 one at a time from the top of the container 220.

Figure 8:
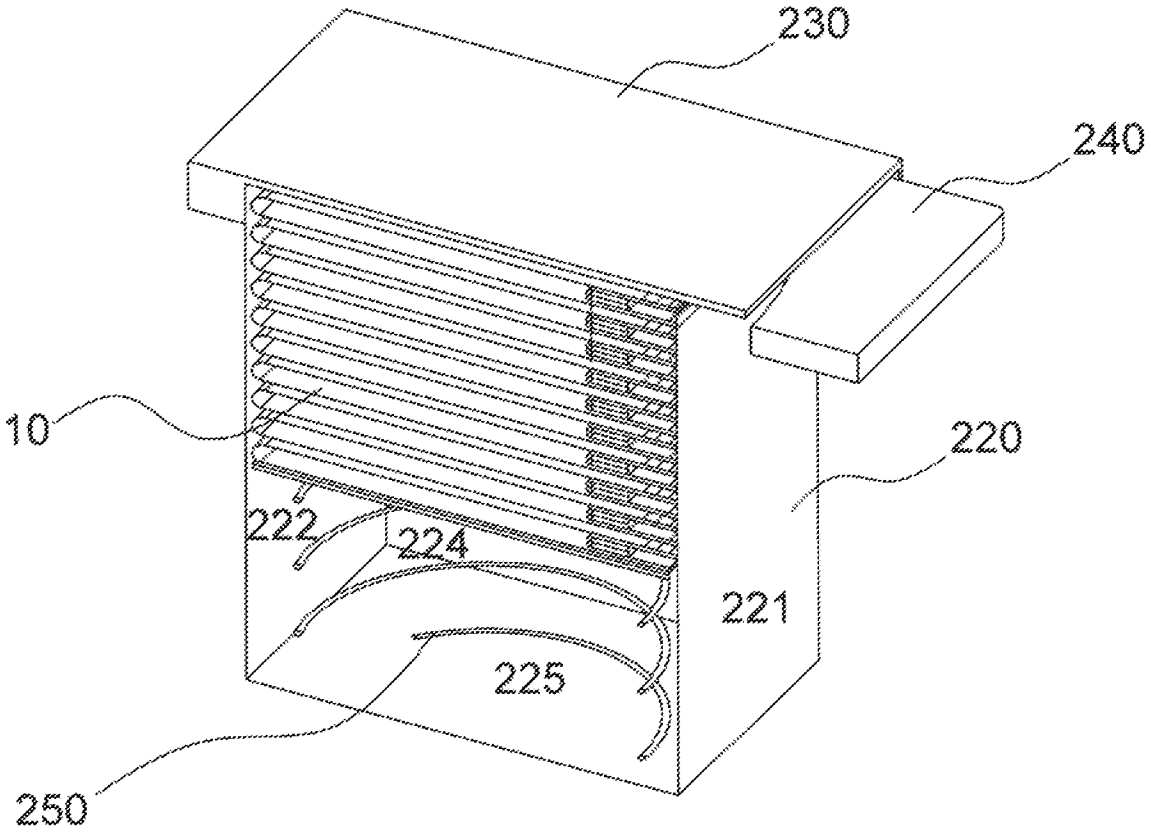
FIG. 8 is a sectional view of the embodiment along the line 7-7 of FIG. 7 showing that a plurality of infusion bags are stored inside the container and are supported by a spring to the top of the container.

As shown in FIG. 8 which is a sectional view along the line 7-7 of the second embodiment disclosed in FIG. 7, the infusion bags are stored horizontally from top to bottom. The container has a compression spring 250 inside to support/push up the infusion bags so that the bag retrieving and opening mechanism 240 extracts the infusion bag from the top of the container 220. Partial of the rear 222, right side 224, and bottom 225 of the container are observable in this figure.

Figure 9:
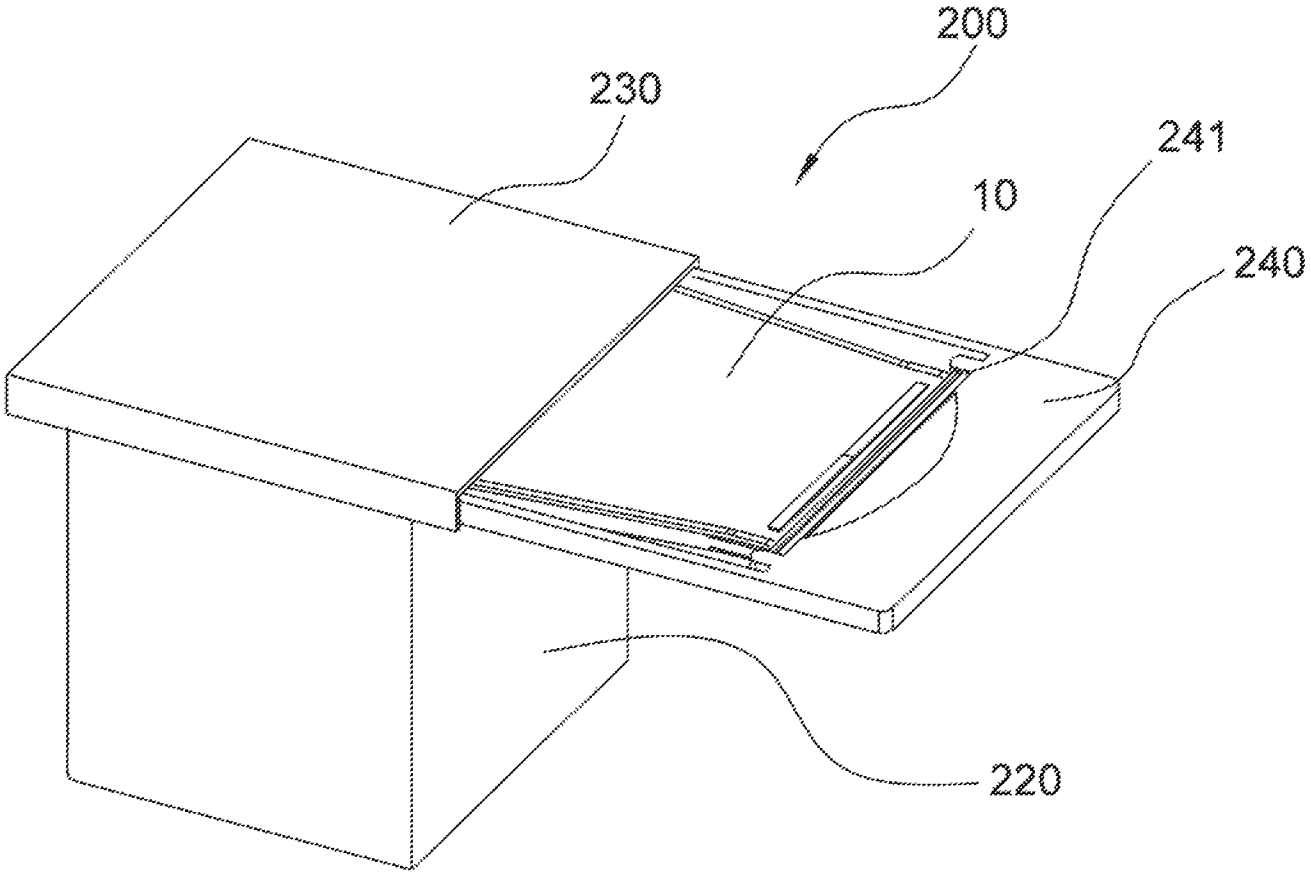
FIG. 9 is an isometric view of the embodiment of FIG. 7 showing that one piece of infusion bags is attached to the sliding bag retriever which is partially moving out of the dispenser lid.

As shown in FIG. 9, the bag retrieving and opening mechanism 240 has a pair of hooks or pins 241 positioned to attach to the holes 13 on the infusion bag. When the bag retrieving and opening mechanism 240 is in the closed position, the hooks or pins 241 attach to the holes 13 of the infusion bag 10 that is on the top of the pile and retrieves the infusion bag 10 out when the bag retrieving and opening mechanism 240 slides out. Other mechanisms known in the art can be used to attach to the infusion bag 10.

Figure 10:
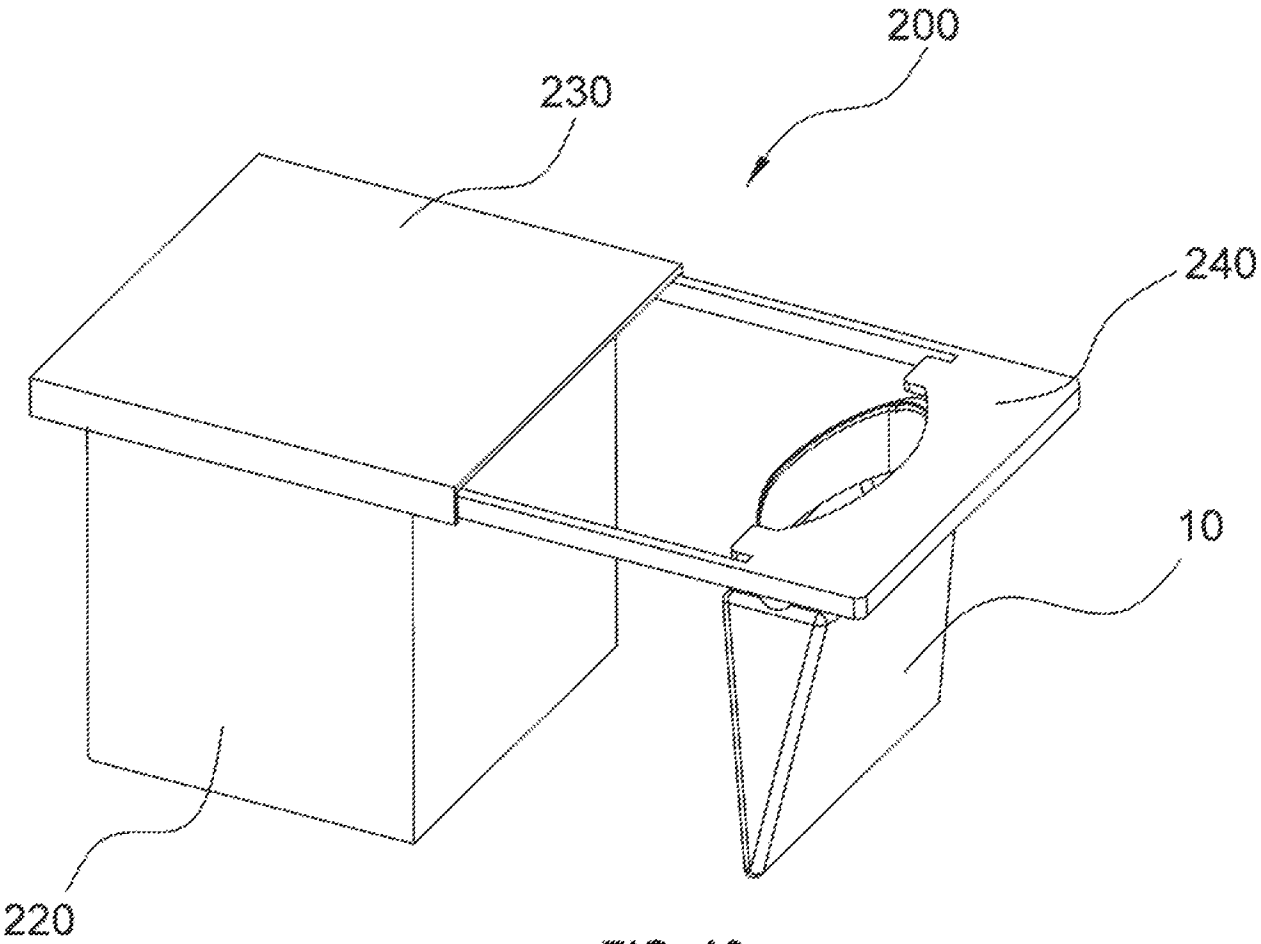
FIG. 10 is an isometric view of the embodiment of FIG. 7 showing that the sliding bag retriever in an open position holding and opening the infusion bag ready for filling infusible substance.

Once the infusion bag is completely pulled out of the dispenser lid 230, the bag retrieving and opening and closing mechanism 240 further has a compression spring mechanism to enable the infusion bag 10 to turn from the horizontal position (see FIG. 9) to a vertical position (see FIG. 10) and has a compression spring mechanism that is able to apply pressure to open the clip 12 (see FIG. 10). Such mechanism to turn the infusion bag 10 can be a hinge in one embodiment. Other mechanisms to turn the infusion bag 10 from the horizontal position (see FIG. 9) to a vertical position (see FIG. 10) known in the art may be used in another embodiment.

In one embodiment, the dispenser lid 230 is removably connected to the container 220 allowing for restocking of the empty infusion bags 10.

Figure 11:
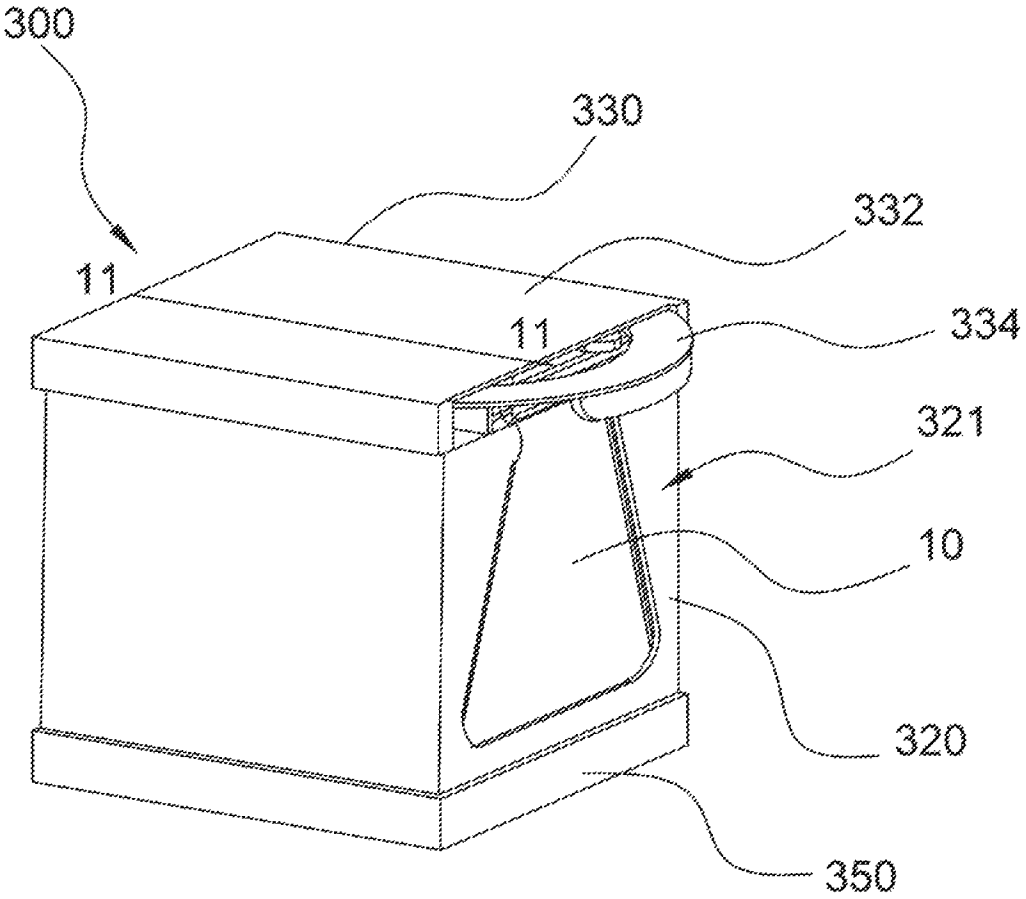
FIG. 11 is an isometric view of the infusion bag dispenser according to a third embodiment of the present invention which has an opening on its front to allow the infusion bag to come out and is at a closed position where the dispenser lid assembly is at a closed position.
Figure 12:
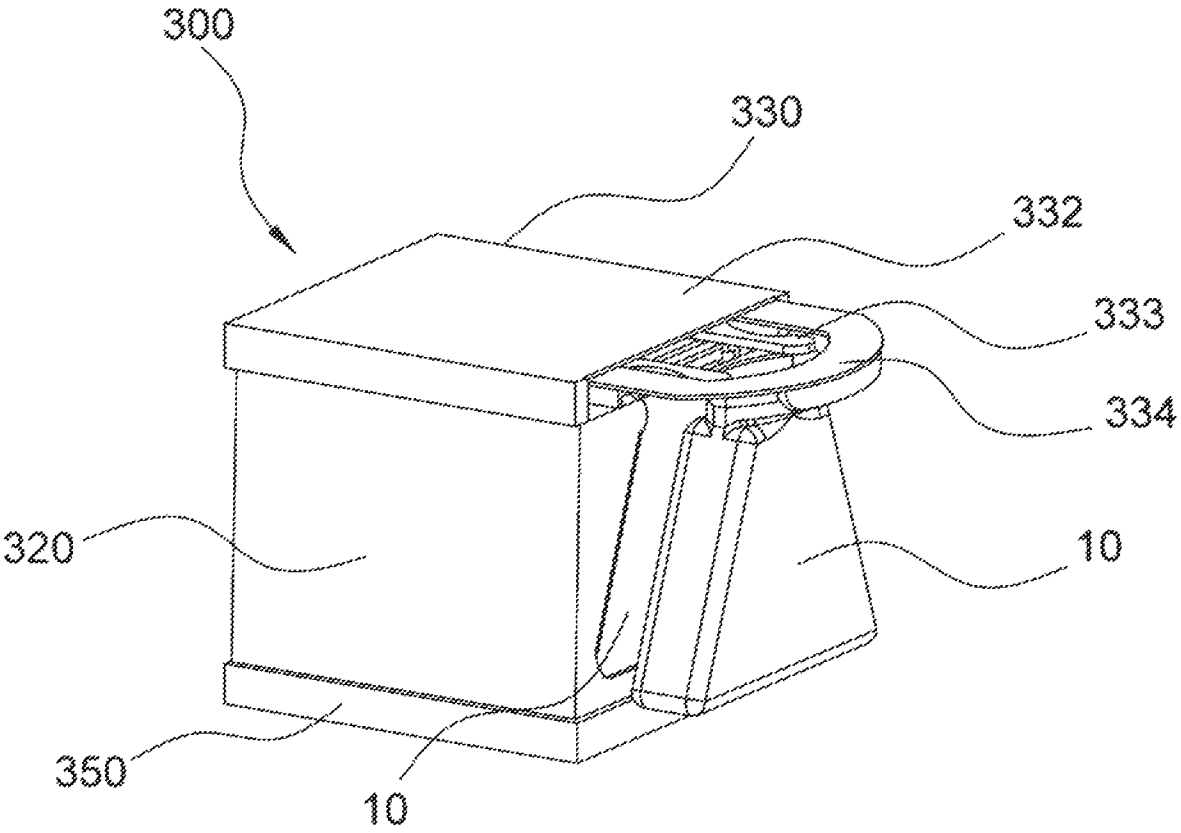
FIG. 12 is an isometric view of the embodiment of FIG. 11 showing the dispenser lid assembly is at a fill position.
Figure 13:
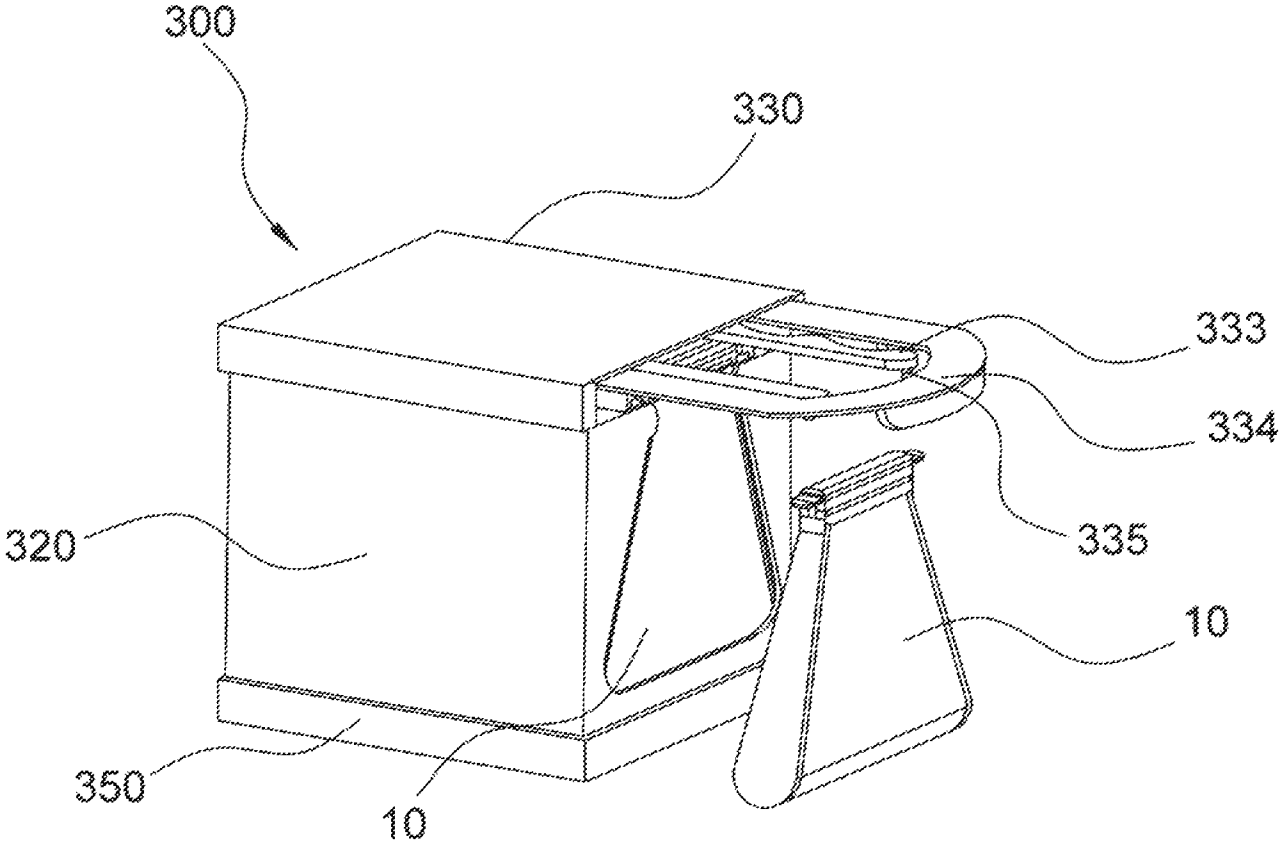
FIG. 13 is an isometric view of the embodiment of FIG. 11 showing the dispenser lid assembly is at a released position.

Referring to FIGS. 11-13, there is disclosed a third embodiment of the infusion bag dispenser 300, comprising a substantially rectangular shaped storage container 320 for storing the infusion bags 10, a dispenser lid assembly 330 located on the top of the storage container 320. The storage container 320 has an opening on its front allowing the infusion bag 10 to exit therefrom for filling. The opening 321 is shaped similar to but slightly larger than the infusion bag 10 in this embodiment. In another embodiment, the opening 321 may have different shape as long as it's large enough to allow the infusion bag 10 to come out. The dispenser lid assembly 330 comprises a dispenser lid 332, a bag dispenser handle 334 which is a bag retrieving and opening mechanism, and two bag arms 333 which are connected to the bag dispenser handle 334. The dispenser handle 334 and bag arms together are sized and configured to mate the dispenser lid 332 so that they can slide in and out of the dispenser lid 332 to retrieve the infusion bag 10 one at a time from the front of the storage container 320. The dispenser lid assembly 330 will be further discussed in later paragraphs.

The infusion bag dispenser 300 further comprises a dispenser base 350 on the bottom of the storage container 320.

FIG. 11 shows the infusion bag dispenser 300 at a closed position wherein the bag arms 333 and dispenser handle 334 are located inside the dispenser lid 332 and all of the infusion bags 10 are stored inside the storage container 320. Although invisible in FIG. 11, the bag arms 333 have a pair of infusion bag pins 335 to engage the holes 13 on the infusion bag 10 thus the bag arms 333 can retrieve the bag 10 when they are pulled out of the dispenser lid 332. As shown in FIG. 12, the bag arms 333 and dispenser handle 334 are partially pulled out of the dispenser lid 332 such that the retrieved infusion bag 10 is vertically disposed outside the container 320 and ready for filling. Once the infusion bag 10 is filled the dispenser handle 334 is further pulled, which triggers the full infusion bag 10 to be released from the infusion bag pins 335 on the bag arms 333 as shown in FIG. 13.

Figure 14:
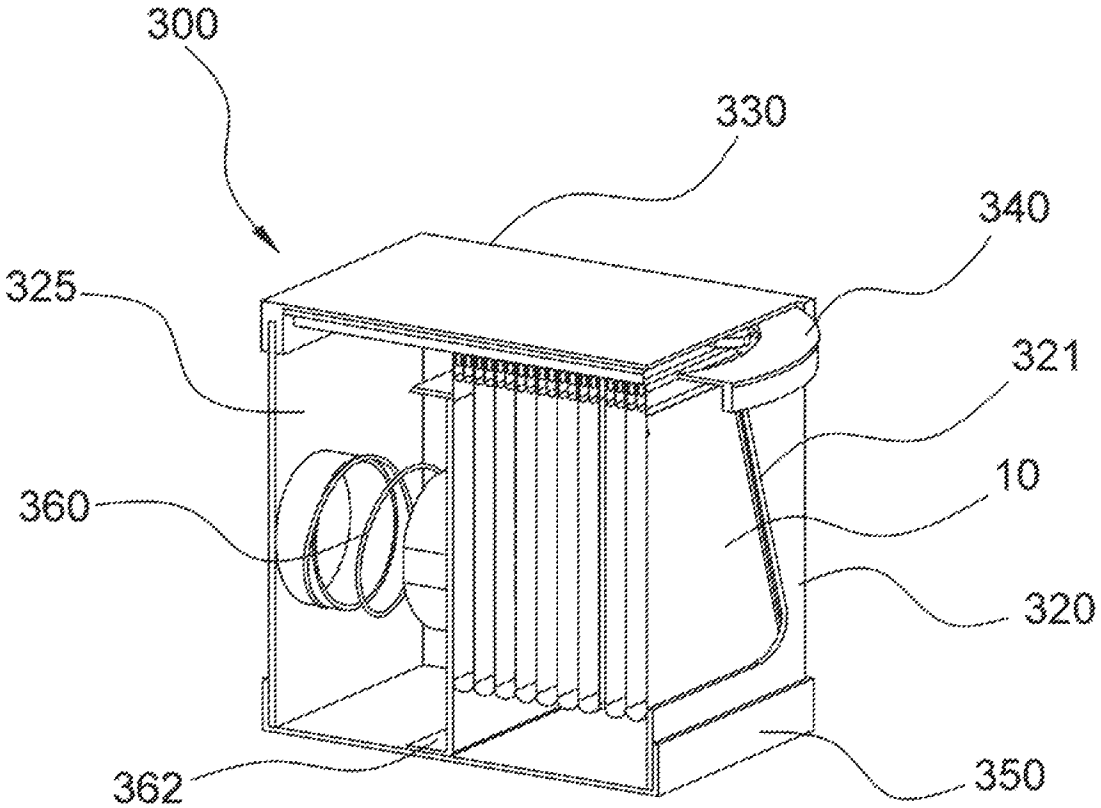
FIG. 14 is a sectional view of the embodiment along the line 11-11 of FIG. 11 showing that a plurality of infusion bags are stored inside the container and are compressed by a compression spring and a pressure towards the front of the container.
Figure 15:
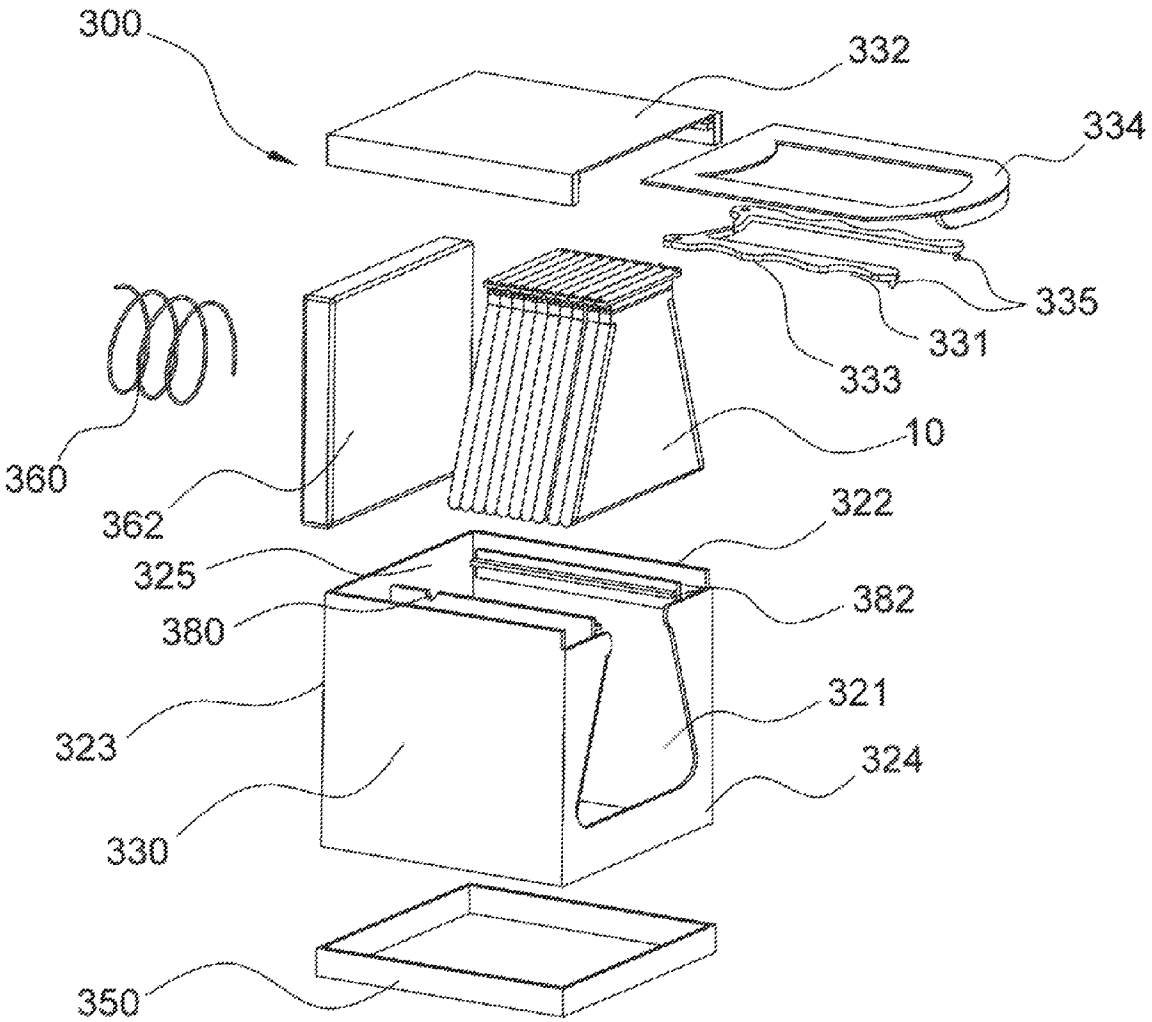
FIG. 15 is an exploded view of the embodiment of FIG. 11
Figure 16:
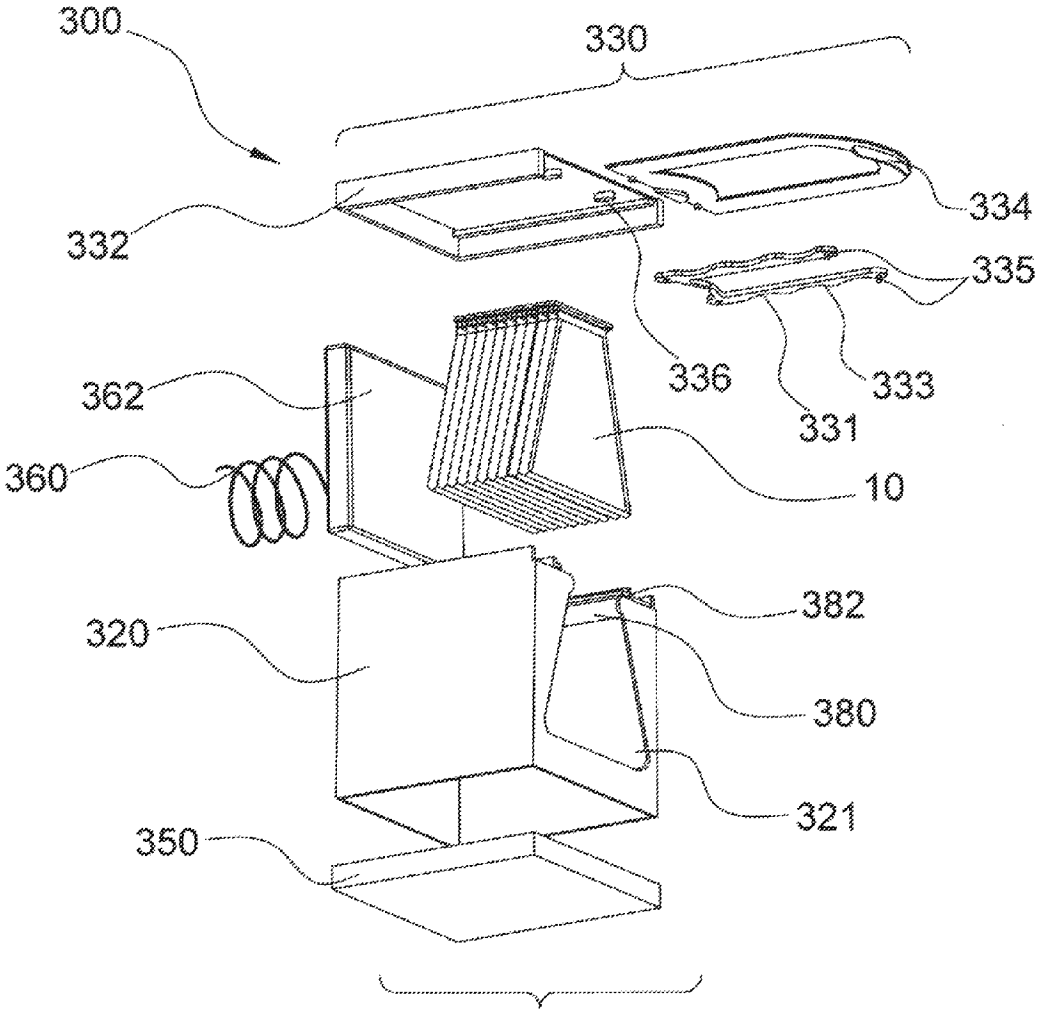
FIG. 16 is an exploded view of the embodiment of FIG. 11 from the bottom.

As shown in FIG. 14 which is a sectional view along the line 11-11 of the third embodiment disclosed in FIG. 11, the infusion bag dispenser 300 stores the infusion bags 10 in an upright direction. The dispenser 300 further comprises a horizontally disposed compression spring 360 and a vertically disposed pressure plate 362 inside the storage container 320. The pressure plate 362 is parallel to and in contact with the stock of the infusion bags 10. The compression spring 360 is attached to the rear wall 325 of the container at one end and to the pressure plate 362 at the other end. The compression spring 360 constantly applies a force horizontally to the pressure plate 362 which is in direct contact with the infusion bags. This causes the infusion bags to be pushed towards the front opening 321. FIGS. 15 and 16 illustrate exploded views of the infusion bag dispenser 300 from slightly different angles. The two parallel bag rails 380 attached to the interior right 322 and left walls 323 respectively extending from the front wall 324 to the rear wall 325 of the container 320 creates two parallel bag retention notches 382 for hanging infusion bags 10 inside the storage container 320.

Each of the bag arms 333 has three semicircular cutouts 331 along the exterior edge to engage each of the two arm cams 336 located on the underside of the dispenser lid 332.

Figure 17:
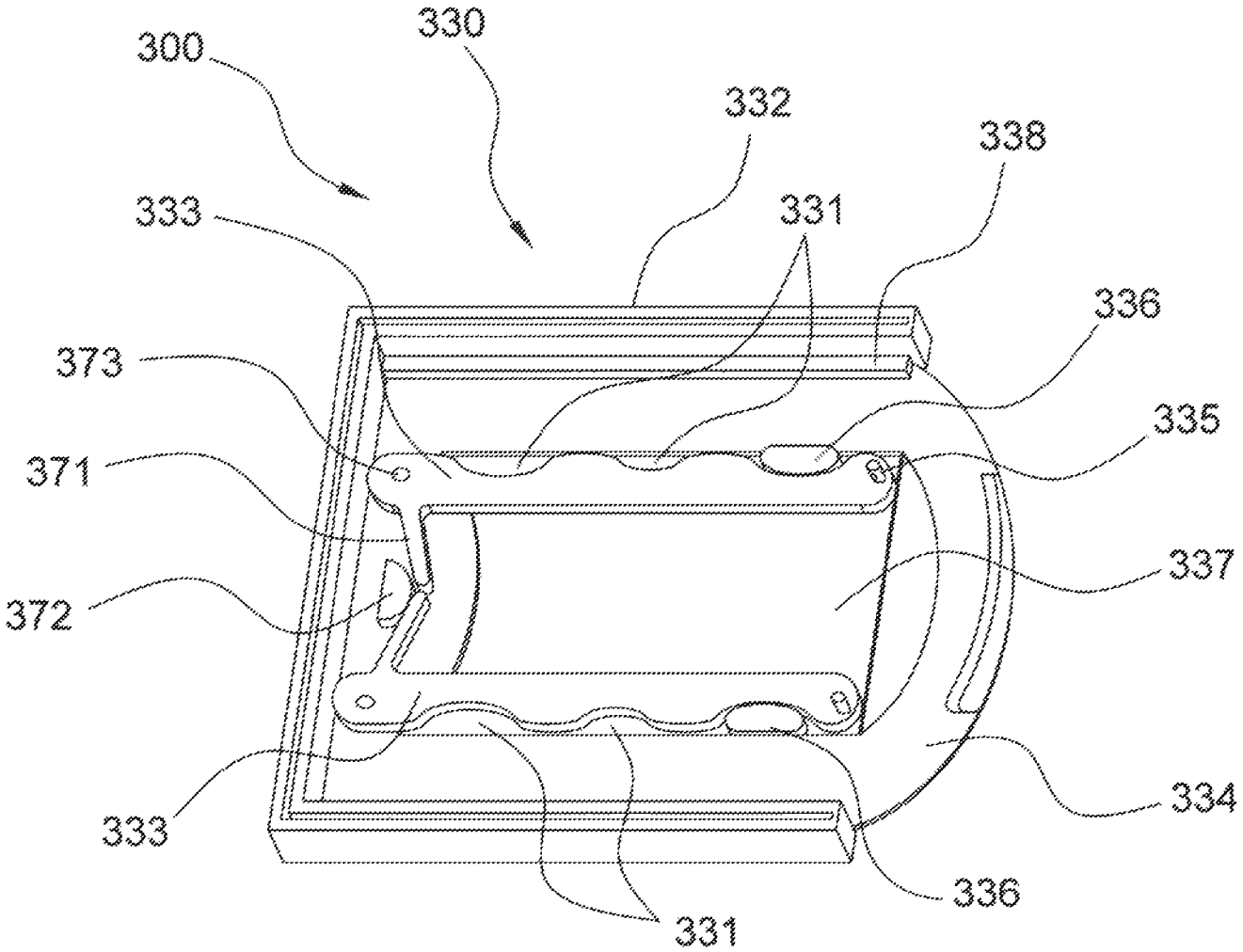
FIG. 17 is a bottom view of the dispenser lid assembly of the embodiment of FIG. 11 at a closed position.
Figure 18:
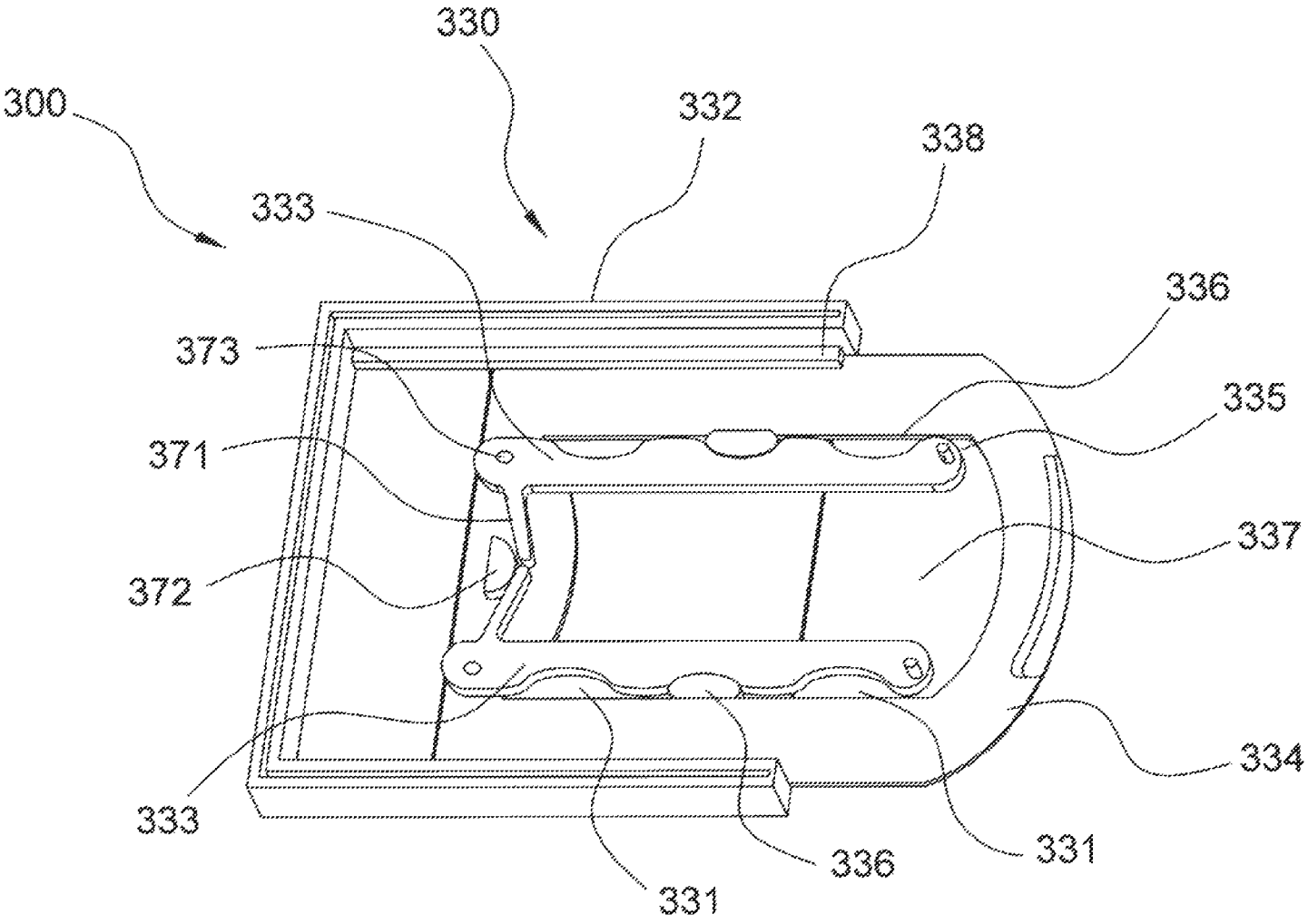
FIG. 18 is a bottom view of the dispenser lid assembly of the embodiment of FIG. 11 at a fill position.
Figure 19:
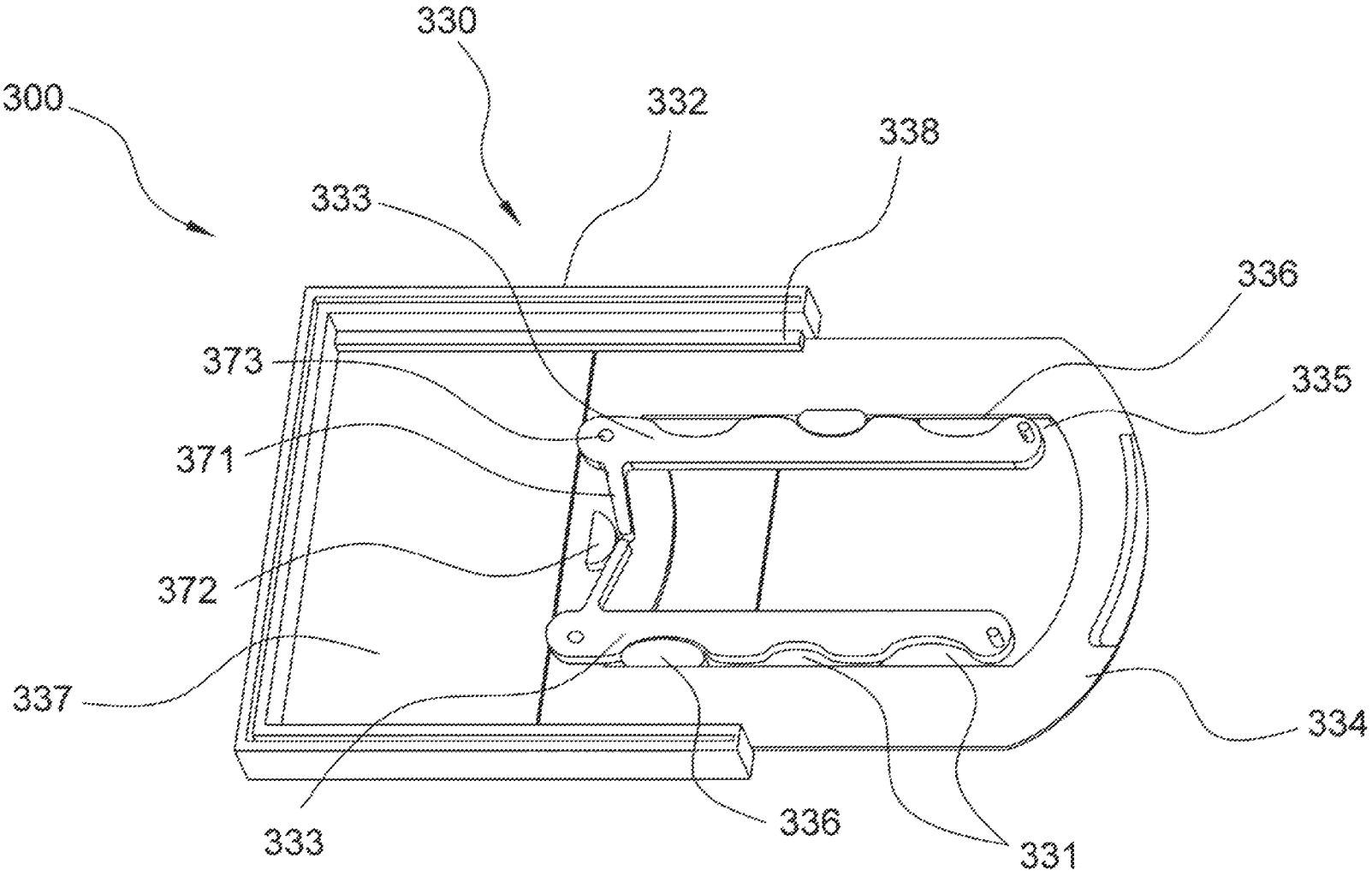
FIG. 19 is a bottom view of the dispenser lid assembly of the embodiment of FIG. 11 at a release position.

Referring to FIGS. 17-19 there disclosed close-up bottom views of the dispenser lid assembly 330 showing the dispenser handle 334 being pulled out to different positions. The right and left bag arms 333 are attached to the handle 334 so that they slide together in and out of the dispenser lid 332 with the handle 334. The space created between the underside 337 of the dispenser lid 332 and the two guiding rails 338 running from the rear to the front on the underside of the dispenser lid 332 allows the handle 334 with bag arms 333 to slide in and out, while the bag arm cams 336 hold the handle 334 with bag arms 333 in place by engaging the cutouts 331 along the bag arms 333. When the bag arm cams 336 engage the front semicircular cutouts 331, the dispenser lid assembly 330 is at its closed position where the handle 334 and bag arms 333 are held inside the dispenser lid 332

(FIG. 17). When the handle 334 and bag arms 333 are partially pulled out, the cams 336 engage the middle semi-circular cutouts 331; the dispenser lid assembly 330 is in a fill position (FIG. 18). When the handle 334 and bag arms 333 are pulled further, the cams 336 engage the rear semi-circular cutouts 331; the dispenser lid assembly 330 is at a release position (FIG. 19), The dispenser lid assembly 330 further comprises tension arms 371, a tension cam 372, and pivot pin 373.

Figure 20:
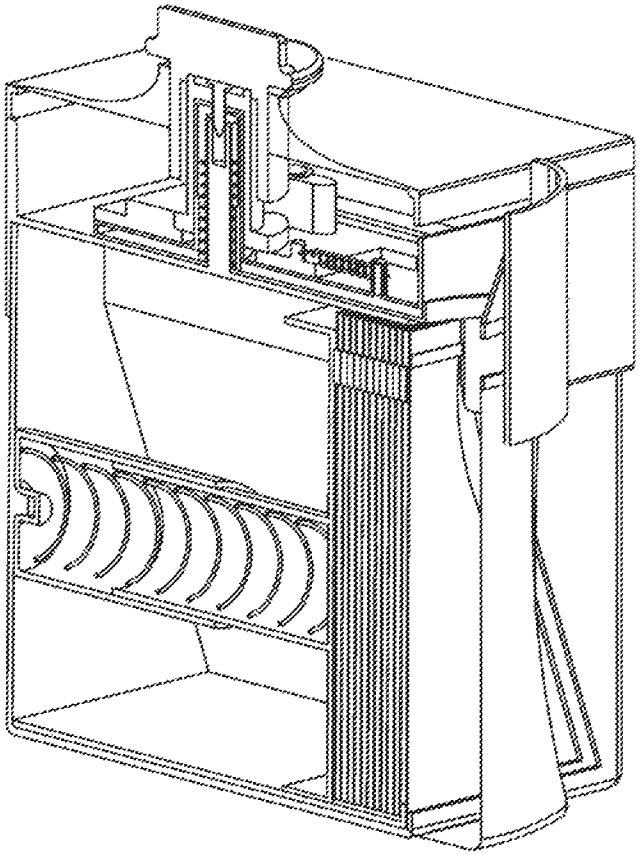
FIG. 20 is a cross sectional view of a fourth embodiment of the present invention
Figure 21:
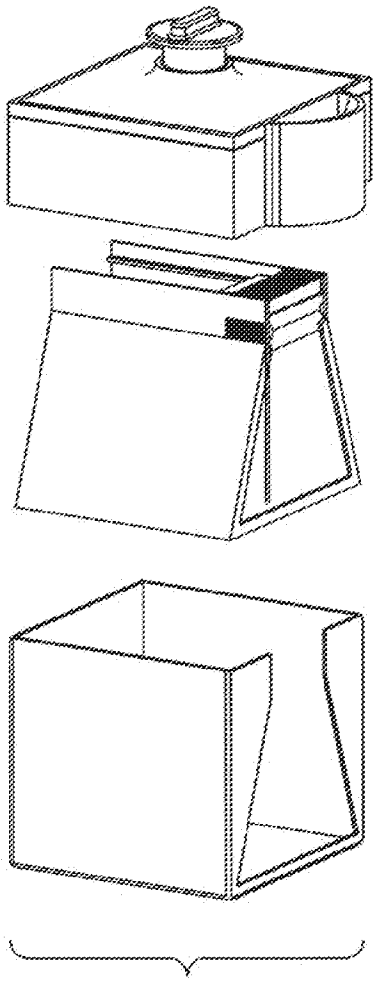
FIG. 21 is an exploded view of FIG. 20
Figure 22:
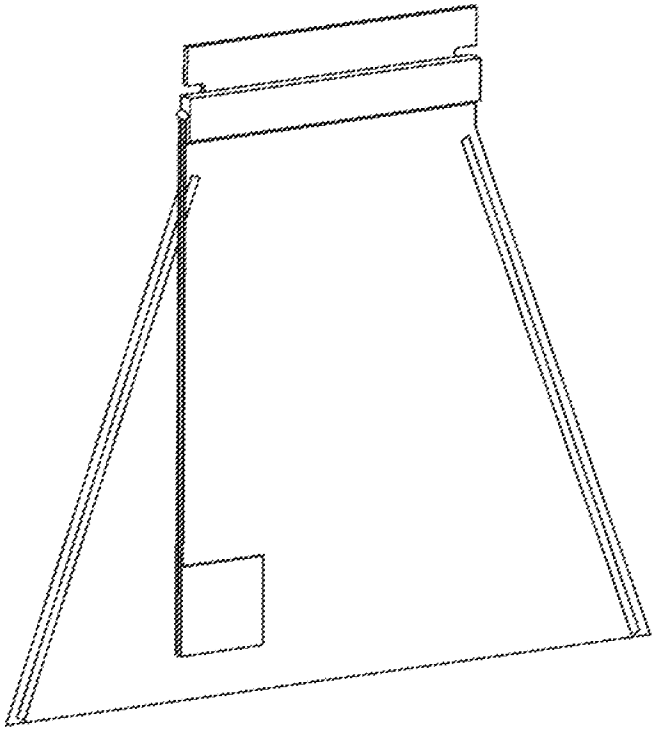
FIG. 22 is a varying embodiment of a dispenser bag used with the fourth embodiment of FIG. 20.
Figure 23:
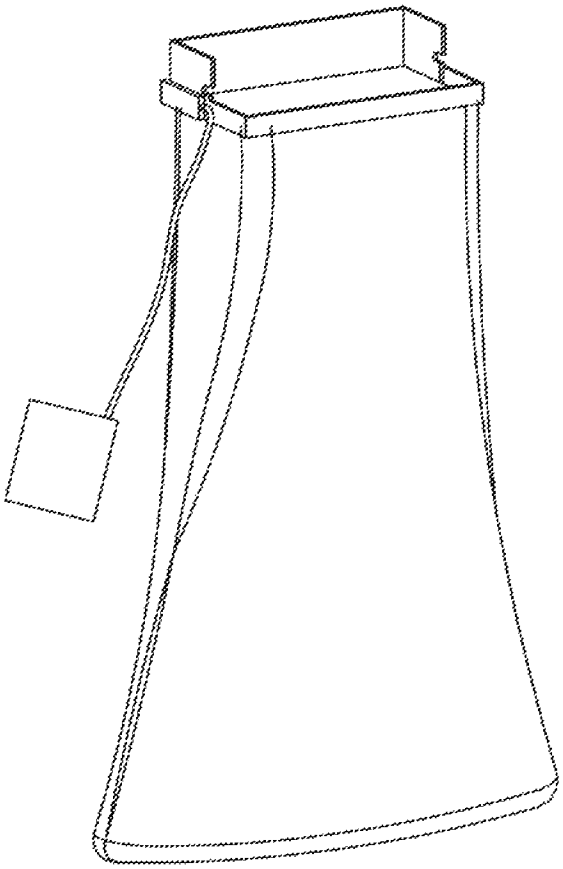
FIG. 23 is an open view of the top portion of dispenser bag of FIG. 22.

Referring to FIG. 20 to FIG. 23 there is shown a fourth embodiment of the present invention. FIG. 20 is a cross sectional view of a fourth embodiment of the present invention. FIG. 21 is an exploded view of FIG. 20. FIG. 22 is a varying embodiment of a dispenser bag used with the fourth embodiment of FIG. 20. FIG. 23 is an open view of the top portion of dispenser bag of FIG. 22.

Herein when referring to FIG. 20 through FIG. 23 the following can be achieved. In the load position, the spade openers are resting on the infusion bag spade opener guide. The control knob is in the full "up" position. The user can depress the control knob until it stops. This action inserts the spade openers into the infusion bag. The user, rotates the control knob 90°, in a clockwise direction. This action engages the rack and pinion assembly, which in turn, rotates the spade openers, and opens the infusion bag. As the spade openers rotate, opening the bag, they also extract the empty infusion bag from the infusion bag canister. The spade openers support the infusion bag, while the user places contents into the open bag. The user rotates the control knob 90°, in a counter-clockwise direction. This action releases the control knob and the return spring moves it back to its original position. The filled infusion bag is released during this process. The user pulls the drawstring on the infusion bag to secure contents.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. An infusion bag dispensing system for packing infusion bags, the infusion bag dispensing system comprising in combination:

a storage container adapted to store and hold a plurality of empty infusion bags;

each of said infusion bags having a porous-walled bag for infusible substance; and a bag retrieving and opening mechanism to retrieve and open said infusion bag and to hold the opened infusion bag in a position to be filled with the infusible substance and release the filled infusion bag;

wherein the infusion bag comprises an open/close mechanism to prevent the infusible substance from exiting the bag; wherein each of the infusion bags has an open/close clip, and two holes at two ends of the clip; wherein said bag retrieving and opening mechanism retrieves the empty bags one at a time for filling by attaching a pair of hooks or pins to the pair of holes at the open/close clip of the infusion bag; and wherein the open/close clip of the infusion bag opens when pressure is applied and closes when pressure is released.

2. The infusion bag dispensing system of claim 1, wherein the infusion bag dispenser stores the infusion bags horizontally.

3. The infusion bag dispensing system of claim 2, wherein the infusion bag dispenser retrieves the empty bag from bottom.

4. The infusion bag dispensing system of claim 3, wherein the infusion bag dispenser comprises:

a substantially rectangular shaped container for storing the infusion bags having two horizontal walls and four vertical walls, one of the vertical walls being slightly shorter than the other three vertical walls forming a gap on its bottom allowing one single piece of the infusion bags to get out of the container; and a bag retrieving and opening mechanism hingedly connected at its top to the container such that the bag retrieving and opening mechanism pivots approximately 90 degrees from a vertically closed position where the door covers the wall with the gap to a horizontally opened position, the bag retrieving and opening mechanism having a means to attach to the holes on the infusion bag when the door is closed;

wherein the infusion bag is retrieved from a bottom of the container through the gap one at a time by the means on the bag retrieving and opening mechanism and is held in a vertical position when the bag retrieving and opening mechanism is held in a horizontal position.

5. The infusion bag dispensing system of claim 4, wherein the pair of hooks or pins is located on an interior side of the bag retrieving and opening mechanism facing towards the gap as the means to engage the pair of holes on the infusion bag.

6. The infusion bag dispensing system of claim 2, wherein the infusion bag dispenser retrieves the empty bag from top.

7. The infusion bag dispensing system of claim 6, wherein the infusion bag dispenser comprises:

a substantially rectangular shaped container for storing the infusion bags having four vertical walls, one bottom wall, and an open top;

a dispenser lid connected to the top of the container to cover the open top;

a sliding bag retriever moving in and out of the dispenser lid to retrieve the infusion bag one at a time from the top of the container; and a compression spring supporting and pushing the infusion bags to the top of the container;

wherein the sliding bag retriever is sized and configured to mate the infusion bag and the dispensing lid such that the sliding bag retriever retrieves a piece of the infusion bags each time when the sliding bag retriever moves in and out of the dispenser lid.

8. The infusion bag dispensing system of claim 7, wherein the dispensing lid has grooves allowing the sliding bag retriever to move in and out.

9. The infusion bag dispensing system of claim 8, wherein the pair of hooks or pins is located on the sliding bag retriever to engage the pair of holes on the infusion bag.

10. The infusion bag dispensing system of claim 8, wherein the pair of hooks or pins is pivotally attached to the sliding bag retriever to engage the pair of holes on the infusion bag to enable the infusion bag to pivot from a horizontal position into a vertical position.

11. The infusion bag dispensing system of claim 1, wherein the infusion bag dispenser stores the infusion bags in an upright direction.

12. The infusion bag dispensing system of claim 11, wherein the infusion bag dispenser comprises:

a substantially rectangular shaped storage container for storing the infusion bags having a front, rear, right, left, top and bottom wall, the front wall having an opening allowing the infusion bag to exit therefrom;

a compression spring and a pressure plate pushing the infusion bags towards the front of the storage container;

a dispenser lid assembly connected to the top wall of the storage container, comprising;

a dispenser lid;

a dispenser handle connected with two bag arms;

wherein the dispenser handle with two bag arms are sized and configured to mate the dispensing lid and the infusion bag such that the dispenser handle with bag arms retrieves a piece of the infusion bags each time when the dispenser handle with bag arms move in and out of the dispenser lid.

13. The infusion bag dispensing system of claim 12, wherein each of the two bag arms has three cutouts located at front, middle and rear of the bag arm; and the dispenser lid has two space-apart bag arm cams to engage the cutouts such that the bag arm cams can hold the bag arms and dispenser handle in place at different positions.

14. The infusion bag dispensing system of claim 13, wherein the pair of pins is located on the two bag arms to engage the pair of holes on the infusion bags.

15. The infusion bag dispensing system of claim 14, wherein the storage container has two parallel bag rails separately attached to interior of the right and left walls and extending from the rear to front walls creating two parallel bag retention notches for suspending the infusion bags inside the storage container.

16. The infusion bag dispensing system of claim 15, wherein the dispenser lid assembly is removably connected to the storage container.

17. The infusion bag dispensing system of claim 16, wherein the dispenser lid assembly further comprises tension arms which are connected to the bag arms and a tension cam to engage the tension arms.

18. The infusion bag dispensing system of claim 1, wherein the infusion bag dispenser opens the infusion bag by applying force to the open/close clip on the bag.

* * * * *